US005208951A

United States Patent [19]

Aoki

[11] Patent Number: 5,208,951

[45] Date of Patent: May 11, 1993

[54] MAGNETIC LOCK DEVICE

[75] Inventor: Yoshihiro Aoki, Tokyo, Japan

[73] Assignee: Application Art Laboratories Co., Ltd., Tokyo, Japan

[21] Appl. No.: 813,011

[22] Filed: Dec. 24, 1991

[30] Foreign Application Priority Data

Dec. 28, 1990 [JP] Japan ..... 2-417578

[51] Int. Cl.[5] ..... A44B 21/00

[52] U.S. Cl. ..... 24/303

[58] Field of Search ..... 24/303; 292/251.5; 335/285; 248/206.5

[56] References Cited

U.S. PATENT DOCUMENTS

| | | | |
|---|---|---|---|
| 4,779,314 | 10/1988 | Aoki | 24/303 |
| 4,941,235 | 7/1990 | Aoki | 24/303 |
| 4,991,270 | 2/1991 | Aoki . | |

FOREIGN PATENT DOCUMENTS

| | | | |
|---|---|---|---|
| 3902289 | 8/1989 | Fed. Rep. of Germany | 24/303 |
| 58121608 | 7/1980 | Japan | 335/285 |
| 1-191404 | 8/1989 | Japan . | |
| 2-105503 | 4/1990 | Japan . | |

*Primary Examiner*—James R. Brittain

*Attorney, Agent, or Firm*—Wenderoth, Lind & Ponack

[57] ABSTRACT

A magnetic lock device comprises two parts, one of which provides the magnetic attraction (referred to as "part A") and the other of which is magnetically attracted by the part A (referred to as "part B"). The part A includes a permanent magnet having a center bore, a first ferromagnetic plate, and a nonmagnetic enclosure having a center bore aligned with the center bore of the permanent magnet for packaging the permanent magnet and first ferromagnetic plate. The part B includes a second ferromagentic plate that can engage the first ferromagnetic plate. Specifically, the nonmagnetic enclosure has a depressed surface on the side on which the second ferromagnetic plate engages the first ferromagnetic plate and which provides a sliding surface for the second ferromagnetic plate to be guided directly toward the center bores of the enclosure and permanent magnet. A magnetic gap is defined between the enclosure and permanent magnet, without or with an intervening annular backup member which is disposed between the enclosure and permanent magnet. The improvement according to the present invention provides advantages in reduced weight and simplified construction.

16 Claims, 3 Drawing Sheets

MAGNETIC LOCK DEVICE

BACKGROUND OF THE INVENTION

1. Field of the Invention

The present invention relates to a magnetic lock device that makes use of the attracting action of the magnetism.

2. Description of the Prior Art

A conventional magnetic lock device includes a permanent magnet having a first side for providing one magnetic polarity to which a first ferromagnetic plate is attached and packaged in a nonmagnetic enclosure, and having a second side opposite the first side for providing opposed magnetic polarity to which a second ferromagnetic plate may be detachably attached. The second ferromagnetic plate has a rod extending therefrom and is adapted to be inserted through respective bores in the permanent magnet and enclosure so that the rod can disengageably engage the first ferromagnetic plate or the rod extending therefrom. The conventional magnetic lock devices are used as attachments for handbags, baggage, and the like, or for clothes, belts, and the like.

According to the conventional magnetic lock device, the ferromagnetic rod on the second ferromagnetic plate is inserted through the respective bores in the permanent magnet and enclosure when the first and second ferromagnetic plates are to be coupled together. When this occurs, a sliding motion of the second ferromagnetic plate relative to the surface of the enclosure must be attempted in order to bring its rod into registry with the bore in the enclosure accurately. Usually, several attempts must be made until the two parts are mated successfully. As those attempts are repeated each time they are to be coupled together, the surface of the enclosure will be damaged, such as by scratches by the sliding motion. There is another conventional magnetic lock device that is primarily designed to eliminate this problem disclosed in Japanese patent applications Nos. 1-191404 and 2-105503. This magnetic lock device includes an enclosure which is formed to present a depressed surface on the side that engages the second ferromagnetic plate.

The last-mentioned conventional magnetic lock device has a construction that includes the enclosure having a depressed surface on the side engaging the second ferromagnetic plate. Thus, when the second ferromagnetic plate is slid relative to the depressed surface of the enclosure so that its rod can be brought into registry with the bore in the enclosure, it may be appreciated that it can be moved directly along the depressed surface toward the bore at the center, without any random effort to locate the bore. This can reduce any possible damage that would occur if the sliding motion would be attempted in the same manner as for the earlier-mentioned prior art construction.

SUMMARY OF THE INVENTION

It is therefore understood that the provision of the depressed surface on the enclosure provides an effective means for protecting the enclosure against possible damage. In this regard, it is an object of the present invention to provide a new and improved construction of the magnetic lock device that permits such a depressed surface to be formed on the enclosure without affecting the functions of the device.

In its specific form, the magnetic lock device according to the present invention includes a permanent magnet having a first side for providing one magnetic polarity to which a first ferromagnetic plate is rigidly attached. The permanent magnet is packaged in a nonmagnetic enclosure. It also includes a second ferromagnetic plate that is adapted to be detachably attached to a second or opposite side of the permanent magnet for providing the opposed polarity. The second ferromagnetic plate has a rod of ferromagnetic material extending therefrom, and the rod can be inserted through respective bores in the permanent magnet and enclosure. The first ferromagnetic plate may also have a rod of ferromagnetic material extending therefrom. When the rod on the second ferromagnetic plate is inserted through the bores, it can engage the first ferromagnetic plate or the corresponding rod thereon. The nonmagnetic enclosure has a depressed surface on the side thereof on which the second ferromagnetic plate engages the enclosure, and has the bore at the center of the depressed surface. The depressed surface is formed on the enclosure such that there is a magnetic gap between it and the second side of the permanent magnet.

The advantage of the magnetic lock device according to the present invention is that the second ferromagnetic plate can be slide along the depressed surface formed on the side of the nonmagnetic enclosure that engages the second ferromagnetic plate to ensure that its rod can be guided directly and accurately toward the bore at the center of the enclosure.

A further advantage of the present invention is that the nonmagnetic enclosure having the depressed surface may be spaced away from the second side of the permanent magnet so that there may be a gap or magnetic gap therebetween. Thus, the enclosure may be made of brass or any other nonmagnetic material that can be machined to the desired shape. This contributes to the reduced weight of the device as a whole. Furthermore, the manufacturing process may be simplified, with less manufacturing costs.

BRIEF DESCRIPTION OF THE DRAWINGS

The above and other objects, features, and advantages of the present invention will become apparent from the following detailed description of preferred embodiments of the invention with reference to the accompanying drawings, in which.

DETAILED DESCRIPTION OF THE PREFERRED EMBODIMENTS

Figure 1:
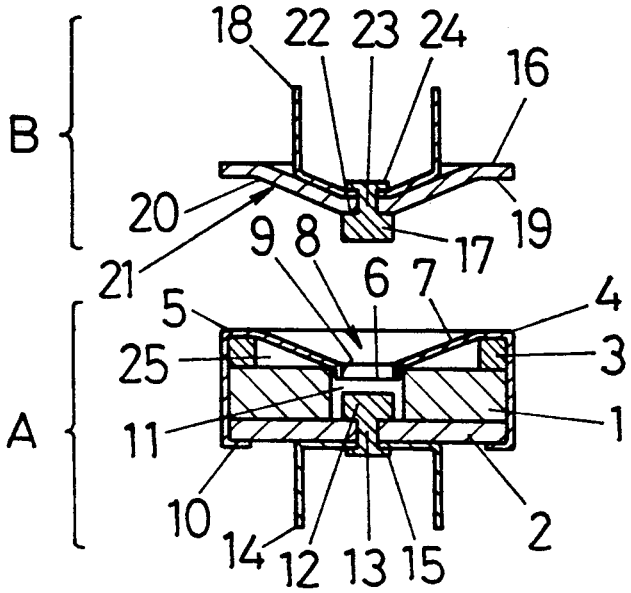
FIG. 1 is a sectional view of a first preferred embodiment of the present invention.

FIG. 1 illustrates a cross section of a magnetic lock device according to a first preferred embodiment. As seen from FIG. 1, the device comprises two parts, generally designated as A and B. The part A, which may be referred to as the "magnetically attracting part", attracts the part B magnetically, which part may be referred to as the "magnetically attracted part". The part A includes a cylindrical permanent magnet 1 having a central bore 11 extending therethrough, a first ferromagnetic plate 2 rigidly attached to a first side of the permanent magnet 1 for providing one magnetic polarity, and an annular member 3 rigidly attached to a second or opposite side of the permanent magnet 1 for providing the opposed polarity. The permanent magnet 1, first ferromagnetic plate 2 and annular member 3 are packaged in a nonmagnetic enclosure 4 that may be made of any nonmagnetic material, such as brass.

The enclosure 4 has a cylindrical shape closed at the top and open at the bottom. On its top side, the enclosure 4 is formed to provide a depressed surface 8 like a funnel, having a peripheral flat portion 5 resting against the annular member 3, a slanted portion 7 extending downwardly and inwardly from the peripheral flat portion 5 toward the center, and a bore 6 at the center. The center bore 6 is formed to include a cylindrical extension 9 depending downwardly therefrom like a skirt. On the bottom end side, it includes nails 10 extending radically inwardly for holding the permanent magnet 1 and the first ferromagnetic plate 2 firmly.

The extension 9 depending downwardly from the center bore 6 forms a cylindrical shape which is fitted inside the center bore 11 through the permanent magnet 1. The first ferromagnetic plate 2 includes a rod 12 extending half the depth into the bore 11. The rod 12 has a shaft 13 extending downwardly therefrom and which passes through the first ferromagnetic plate 2. The bottom end of the shaft 13 has a press-formed flange or rivet 15 extending radially outwardly so that it can hold a pair of mounting legs 14 and secure them to the first ferromagnetic plate 2.

The part B, of the magnetically attracted part, includes a second ferromagnetic plate 16, a rod 17 also made of ferromagnetic material and extending from the second ferromagnetic plate 16 on the side thereof facing the part A, and a pair of mounting legs 18 secured to the second ferromagnetic plate 16 on the opposite side thereof. The second ferromagnetic plate 16 is made of iron, and is formed to include a peripheral marginal flat edge 19 whose shape conforms to the shape of the corresponding annular flat portion 5 of the enclosure 4. A slanted portion 20 extends radially inwardly from the peripheral marginal flat edge 19, the slanted portion 20 forming a protruded surface 21 matching the shape of the corresponding depressed surface 8 on the enclosure 4. The protruded surface 21 is flat at the center thereof, as shown at 22, where a bore is provided for accepting a rod 17. The rod 17 has the diameter that allows the rod 17 to be inserted into the cylindrical part 9 on the enclosure 4, and a length or height that allows the rod 17 to meet flatly with the corresponding ferromagnetic rod 12 on the first ferromagnetic plate 2 when the second ferromagnetic plate 16 is placed on and magnetically attracted toward the enclosure 4. The rod 17 has a shaft 23 whose bottom end is press-formed to include a flange 24 for holding the pair of mounting legs 18 and securing them to the second ferromagnetic plate 16 in the same manner as described with reference to the part A.

According to the embodiment of the magnetic lock device described above, it may be appreciated that the second ferromagnetic plate 16 for the part B may be magnetically attracted toward the part A including the permanent magnet 1 when the plate 16 is placed on the enclosure 4, or may be detached from the part A by pulling it away from the part A. This may be accomplished by placing the second ferromagnetic plate 16 on the enclosure in such a way that the peripheral marginal flat edge 19 and protruded surface 21 of the plate 19 can engage the corresponding respective annular flat portion 5 and depressed surface 8 of the enclosure 4. When this occurs, the rod 17 of the second ferromagnetic plate 16 can meet the rod 12 of the first ferromagnetic plate 2 at their respective ends. When those rods meet, the magnetic lines of force from the permanent magnet 1 are centered onto the rods 12 and 17 through their respective ferromagnetic plates 2 and 16. Thus, the rods can attract each other under the action of the centered magnetic force.

More specifically, the operation may be performed in the following manner. When the part A and the part B are to be coupled together, the second ferromagnetic plate 16 is placed onto the enclosure 4, and its rod 17 may be inserted into the center bores 6 and, 11 by sliding it relative to the top surface of the enclosure 4. By doing this, the rod 17 can be guided along the slant 7 formed by the depressed surface 8 on the enclosure 4 toward the center bore 6. The minimum amount of effort may be required to direct the rod 17 toward the bore 6 by restricting its sliding motion to the shortest way to the bore 6. In this way, damage such as scratches on the enclosure 4 that may be caused by the sliding motion can be avoided, as is the case with the prior art which provides improvement in this regard.

The annular member 3 is interposed between the permanent magnet 1 and the enclosure 4 so that a gap 25 can be defined between the top side of the enclosure 4 and the polar side of the permanent magnet 1 facing the top side. This gap is functionally equivalent to a magnetic gap in the magnetic circuit. The total weight of the device can be reduced by the amount of the gap 25. The annular member 3 has a simple configuration, and the fabrication process may be simplied by using this annular member 3. The annular member 3 may be made of either ferromagnetic materials or nonmagnetic materials. Preferably, the annular member should be made of brass or similar materials that can be cut to the desired shape. When the annular member is made, any nonmagnetic materials, brass, copper, or synthetic resins may be used. The annular member may consist of two split parts, each having an identical shape, such as a semi-circular shape, which may be assembled together into one unit.

FIGS. 2 through 5 show several variations of the preceding embodiment. In the variation shown in FIG. 2, the magnetic gap 25 in FIG. 1 is filled with another annular member 26 made of brass.

Figure 2:
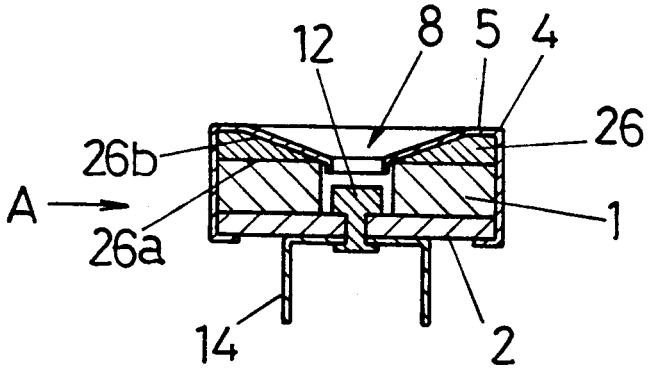
FIG. 2 illustrates a cross section of a part of the device according to a second preferred embodiment that provides a magnetically attracting action.

As seen from FIG. 2, the annular member 26 includes a bottom side 26a which engages the second polar side of the permanent magnet 1, and an upper side 26b whose shape conforms to the shape of the top surface of the enclosure 4. The annular member 26 may appear to have a slightly complicated profile, but it can be shaped to the desired profile by using brass, copper, or synthetic resin materials.

Figure 3:
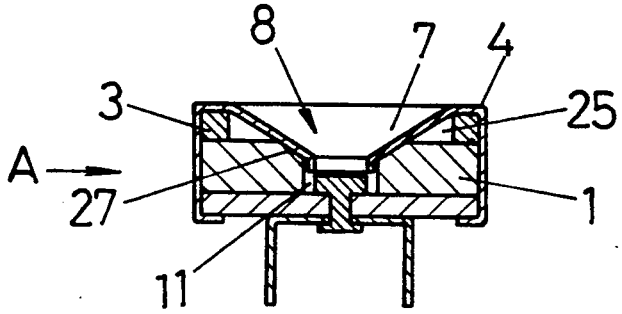
FIG. 3 illustrates a cross section of a magnetically attracting part according to a third preferred embodiment.

In the variation shown in FIG. 3, the permanent magnet 1 has a center bore 11 whose upper peripheral edge is cut to provide a slant 27, and the enclosure 4 has a depressed surface 8 that presents a steeper slant 7 that matches the slant 27. In this variation, the annular member 3 may also be made of either ferromagnetic or nonmagnetic materials.

Figure 4:
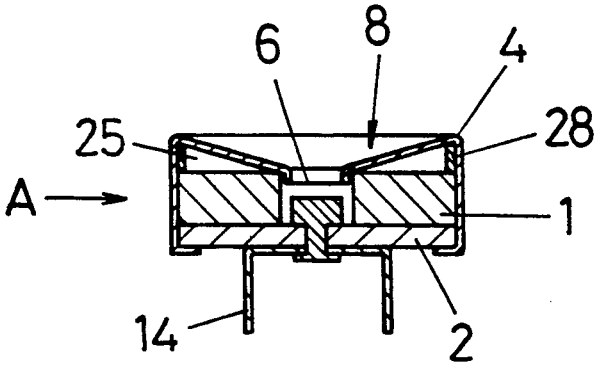
FIG. 4 illustrates a cross section of a magnetically attracting part according to a fourth preferred embodiment.

FIG. 4 shows a variation of the annular member, in which an annular member 28 has a cylindrical shape and is disposed on the second polar side of the permanent magnet 1. The enclosure 4 has the depressed surface 8 on its top, beginning with the peripheral edge and slanting downwardly toward the center bore 6.

Figure 5:
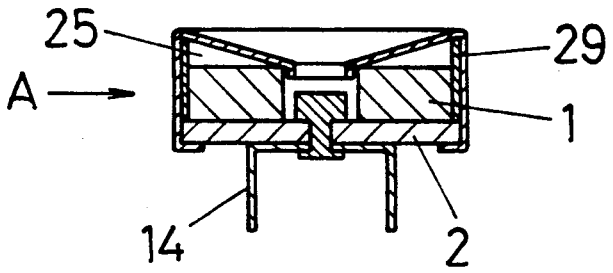
FIG. 5 illustrates a cross section of a magnetically attracting part according to a fifth preferred embodiment.

FIG. 5 shows a further variation of the annular member 28 in FIG. 4, in which the first ferromagnetic plate 2 has a slightly greater diameter than the permanent magnet 1, and an annular member 29 has a cylindrical shape which surrounds the permanent magnet 1.

The annular member 28 shown in FIG. 4 may be made of either ferromagnetic or nonmagnetic materials, whereas the annular member 29 in FIG. 5 should be made of nonmagnetic materials.

In each of those specific variations described above, a magnetic gap 25 may be provided between the permanent magnet 1 and the enclosure 4 on the top side thereof, or a magnetic gap may be provided by the annular member 26, 28, or 29. This gap reduces the weight, and makes the fabrication easy. When the annular member is made of nonmagnetic materials, brass, copper, or synthetic resin material may also be used. The annular member may also consist of two split pieces.

Figure 6:
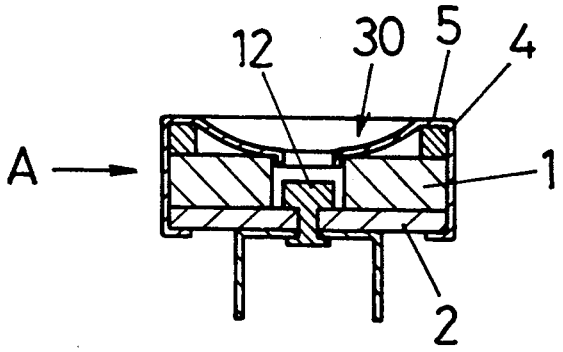
FIG. 6 illustrates a cross section of a magnetically attracting part having a depressed surface varying in profile from those in the preceding embodiments.

In the preceding embodiments and the variations thereof, the depressed surface 8 on the top of the enclosure 4 provides a linearly slanted surface 7. The depressed surface 8 may, however, provide a curved slant surface 30 as shown in FIG. 6.

Figure 7:
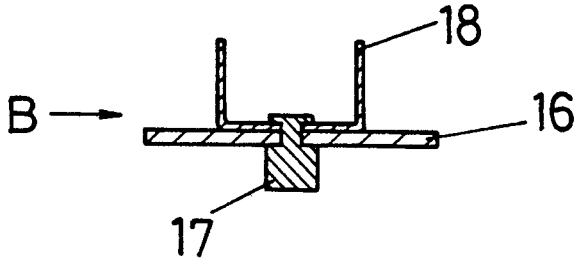
FIG. 7 illustrates a cross section of a magnetically attracted part of the device according to another preferred embodiment.

In each of the preceding embodiments, the second ferromagnetic plate 16 on the part B provides the protruded surface 21 whose shape matches the shape of the depressed surface 8 on the enclosure 4. Alternatively, the shape may be flat as shown in FIG. 7. In this case, it is important to ensure that the rod 12 of the part A and the rod 17 of the part B can meet each other flatly when the two parts A and B are coupled.

Figure 8:
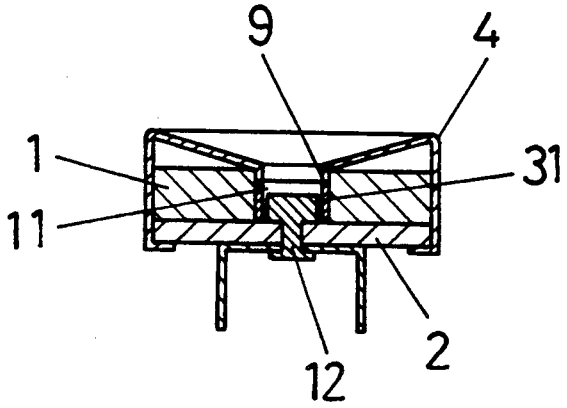
FIG. 8 illustrates a cross section of a magnetically attracting part according to a sixth preferred embodiment.
Figure 9:
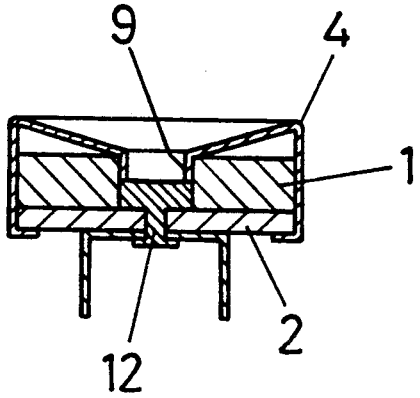
FIG. 9 illustrates a cross section of a magnetically attracting part according to a seventh preferred embodiment.

The variation shown in FIG. 5 may be varied as shown in FIG. 8 and FIG. 9, respectively.

In FIG. 8, the annular member 29 may be omitted, and instead an annular member 31 which may be made of ferromagnetic or nonmagnetic materials may be fitted inside the bore 11 through the permanent magnet 1. In this case, the peripheral bottom end 9 of the enclosure 4 that extends into the bore 11 may be supported by the peripheral upper end of the annular member 31.

In FIG. 9, the peripheral bottom end 9 of the enclosure 4 may be supported by the peripheral marginal edge of the rod 12.

In FIGS. 8 and 9, the enclosure 4 can be also supported firmly, and the magnetic gap can be defined between the enclosure 4 and permanent magnet 1. The constructions in FIGS. 8 and 9 may provide the same functional effects as those in the preceding embodiment and variations thereof.

According to the present invention, the rod for the magnetically attracted part can be directed toward the center bore by sliding it relative to the enclosure when that part is coupled with the magnetically attracting part without causing any possible damage such as scratches, on the enclosure during the sliding motion. The gap provided between the permanent magnet and enclosure reduces the weight and makes the fabrication easy.

Although the present invention has been described in full detail by referring to the preferred embodiments and variations thereof, it should be understood that various changes and modifications may be made without departing from the spirit and scope of the invention.

What is claimed is:

1. A magnetic lock device, comprising:

a first element comprising a permanent magnet with a center bore extending therethrough, said permanent magnet having a first side for providing one polarity and a second side opposite to said first side for providing the opposite polarity, a first ferromagnetic plate rigidly attached to said one side of said permanent magnet, a rod of ferromagnetic material extending from said first ferromagnetic plate into said center bore of said permanent magnet, and a nonferromagnetic enclosure housing said permanent magnet and said first ferromagnetic plate as a single unit, said nonferromagnetic enclosure having a center bore aligned with said center bore of said permanent magnet; and a second element comprising a second ferromagnetic plate for detachable attachment with said first ferromagnetic plate of said first element and a rod of ferromagnetic material extending from said second ferromagnetic plate for at least indirectly detachably engaging said first ferromagnetic plate through said rod of ferromagnetic material of said first element when said rod of said second element extends through said center bores of said nonferromagnetic enclosure and said permanent magnet;

wherein said nonferromagnetic enclosure has a depressed surface inclining downwardly from a peripheral marginal edge thereof toward said center bore; and wherein an air gap is defined between said depressed surface of said nonferromagnetic enclosure and said second side of said permanent magnet.

2. The magnetic lock device of claim 1, wherein said depressed surface of said nonferromagnetic enclosure inclines linearly downwardly toward said center bore.

3. The magnetic lock device of claim 1, wherein said depressed surface of said nonferromagnetic enclosure inclines in a curve downwardly toward said center bore.

4. The magnetic lock device of claim 1, wherein said enclosure comprises a cylindrical body portion, and an upper end of said cylindrical body portion defines said peripheral marginal edge from which said depressed surfaces downwardly inclines.

5. The magnetic lock device of claim 1, wherein:

said enclosure has a flat annular portion surrounding said depressed surface about said peripheral marginal edge; and said second ferromagnetic plate is shaped to have a downwardly inclined surface matching said depressed surface of said enclosure and a flat annular portion surrounding said downwardly inclined surface matching said flat portion of said enclosure.

6. The magnetic lock device of claim 1, and further comprising an intervening nonmagnetic member between said permanent magnet and said enclosure partly defining said air gap between said enclosure and said permanent magnet.

7. The magnetic lock device of claim 6, wherein said intervening nonmagnetic member is annular.

8. The magnetic lock device of claim 1, wherein:

said enclosure has a flat annular portion surrounding said depressed surface about said peripheral marginal edge; and an annular intervening member is disposed between said permanent magnet and said enclosure so as to define said air gap together with said enclosure and said permanent magnet, said annular intervening member being disposed below said flat annular portion and said air gap being radially inside said annular intervening member.

9. The magnetic lock device of claim 8, wherein said permanent magnet has an inclined surface thereon corresponding to said depressed surface of said enclosure and located adjacent to said center bore.

10. The magnetic lock device of claim 1, wherein:

said enclosure comprises a cylindrical body portion, and an upper end of said cylindrical body portion defines said peripheral marginal edge from which said depressed surfaces downwardly inclines; and an annular cylindrical intervening member is provided along the inner surface of said cylindrical body portion partly defining said air gap between said enclosure and said permanent magnet.

11. The magnetic lock device of claim 10, wherein said permanent magnet has an annular space therearound between said permanent magnet and said cylindrical body portion, said annular cylindrical intervening member being disposed in said space.

12. The magnetic lock device of claim 10, wherein said annular cylindrical intervening member extends from an upper surface of said permanent magnet to a point on said inner surface corresponding to said peripheral marginal edge.

13. The magnetic lock device of claim 1, wherein said enclosure has a cylindrical extension at said center bore thereof extending downwardly from said depressed surface into said center bore of said permanent magnet.

14. The magnetic lock device of claim 13, wherein said cylindrical extension extends downward into contact with said rod of ferromagnetic material of said first ferromagnetic plate.

15. The magnetic lock device of claim 13, wherein an annular member is disposed between said cylindrical extension and said first ferromagnetic plate in said center bore of said permanent magnet, with said rod of ferromagnetic material of said first ferromagnetic plate extending inside said annular member.

16. The magnetic lock device of claim 1, wherein said air gap extends from said second side of said permanent magnet to the interior surface of said enclosure at said depressed surface thereof.

* * * * *